US005600871A

United States Patent [19]

Mandl et al.

[11] Patent Number: 5,600,871

[45] Date of Patent: Feb. 11, 1997

[54] COMBING MACHINE HAVING PNEUMATIC DETACHMENT ASSIST

[76] Inventors: Gerhard Mandl, Strehlgasse 8, CH-8311 Brütten; Hans-Peter Meile, Pestalozzistrasse 12, CH-8404 Winterthur, both of Switzerland

[21] Appl. No.: 526,041

[22] Filed: Sep. 8, 1995

[51] Int. Cl.[6] ..... D01G 19/00

[52] U.S. Cl. ..... 19/215; 19/235

[58] Field of Search ..... 19/216, 215, 219, 19/235, 272

[56] References Cited

U.S. PATENT DOCUMENTS

| | | | |
|---|---|---|---|
| 2,802,241 | 8/1957 | Dudley | 19/216 |
| 3,103,041 | 9/1963 | Nydam | 19/235 X |
| 3,479,699 | 11/1969 | Von Kaenel et al. | 19/223 |
| 5,131,117 | 7/1992 | Gallo et al. | 19/234 |
| 5,148,575 | 9/1992 | Clement | 19/235 |

FOREIGN PATENT DOCUMENTS

| | | | |
|---|---|---|---|
| 1441658 | 4/1902 | France | 19/219 |
| 485873 | 3/1970 | Switzerland . | |

*Primary Examiner*—John J. Calvert
*Attorney, Agent, or Firm*—Martin A. Farber

[57] ABSTRACT

A combing machine having a pair of detachment rolls (6") and a nipper head (3) which, during a nip, carries out a forward stroke towards the pair of detachment rolls (6") and a return stroke. In the path of the stroke of the nipper head (3) active apparatus (26, 27, 28) is present in order to force a fiber tuft (10) into a given relative position with respect to the nipper head (3) at least at the end of the forward stroke movement.

6 Claims, 4 Drawing Sheets

COMBING MACHINE HAVING PNEUMATIC DETACHMENT ASSIST

FIELD AND BACKGROUND OF THE INVENTION

The present invention relates to a combing machine having a pair of detachment rolls, and a nipper head which, during a nip, effects a forward stroke towards the pair of detachment rolls as well as a return stroke.

In combing machines which operate in accordance with the Nasmith principle, the web is completely separated and then brought together again during a nip, i.e. during a complete stroke cycle of the nipper. Although the separating by an extensive drawing between defined clamping points does not raise any problem, the bringing together of the web, referred to as "piecing", encounters difficulties.

Piecing is a very important quality feature. Good piecing of the web (top) is characterized by a parallel, stretched position of the fibers, connected with uniform distribution of the fibers in longitudinal and transverse directions.

Good piecing requires an undisturbed application of the starting end of the following fiber structure (i.e. of the fiber tuft) onto the trailing end of the top.

On the one hand, with increasing frequency of stroke of the nipper or with an increasing number of nips, undisturbed piecing becomes more and more difficult. On the other hand, a high number of nips is desired since the production of combed sliver can thus be directly increased. Every spinning mill is confronted by the task of finding a suitable compromise between productivity and quality upon combing.

For reasons of economy, therefore, the highest possible number of nips without disturbing reductions in quality is desirable.

SUMMARY OF THE INVENTION

It is an object of the present invention is to increase the number of nips while at the same time retaining good quality of piecing.

In accordance with the invention, in a path of the strokes of the nipper head, there are present active means for forcing a fiber tuft into a given relative position with respect to the nipper head at least at the end of the forward stroke movement.

BRIEF DESCRIPTION OF THE DRAWINGS

With the above and other objects and other advantages in view, the present invention will become more clearly understood in connection with the detailed description of preferred embodiments, when considered with the accompanying drawings of which.

DETAILED DESCRIPTION OF THE PREFERRED EMBODIMENTS

Figure 1:
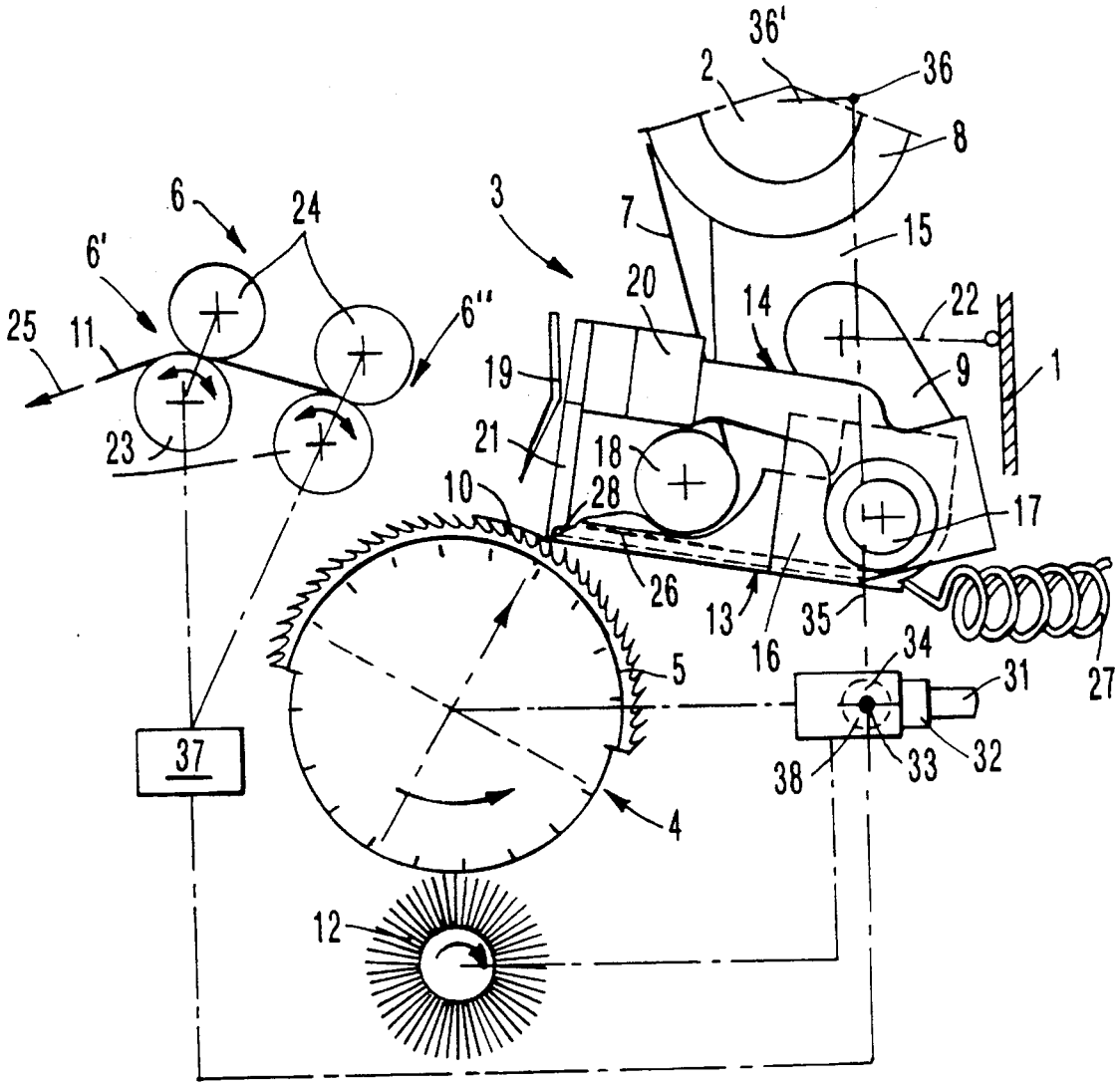
FIG. 1 is a cross section through a combing machine, the fiber tuft being combed out by the comb cylinder.

FIG. 1 shows the construction, in principle, of a combing machine such as described in detail in U.S. Pat. No. 3,479,699 (Swiss patent 485 873). In the machine stand 1, a nipper head 3 is swingably fastened by a clamp 8 on a nipper shaft 2, a combing cylinder 4 having a needle segment 5 being associated with the nipper head 3. The nipper head 3 cooperates with detachment rolls 6. The wadding 7 to be combed is fed continuously to the nipper head from a lap roll (not shown), which rests on a pair of continuously driven shafts, also not shown. The front end of the wadding 7, the so-called fiber tuft 10, is connected (called piecing) to the top 11 which is held between the detachment rolls 6—following a pilgrimstep-like rearward movement of the top—moved away, and detached from the following wadding 7. The comber waste (noils) combed out from the fiber tuft 10 is removed from the needle segment 5 by a brush roller 12 rotating in opposite direction with high circumferential speed. The nipper head 3 has a lower nipper 13 pivoted to the nipper shaft 2 and an upper nipper 14 swingably mounted.

The on said lower nipper 13. The lower nipper 13 consists essentially of a lower-nipper arm 15 and a lower-nipper plate 16 fastened to it. The upper nipper 14 is swingably mounted having an upper nipper plate 21 (knife) on the lateral swivel pins 17 of the lower-nipper arm 15. In the lower nipper 13 there is supported a feed roller 18 for the wadding 7 which converts the continuous advance of the wadding into a discontinuous advance. The intermittent drive of the feed roller 18 is effected in the rhythm of the movement of the nipper head by means of a pawl drive, not shown, but described in detail in U.S. Pat. No. 3,479,699 (Swiss Patent 485/873)

Figure 5A:
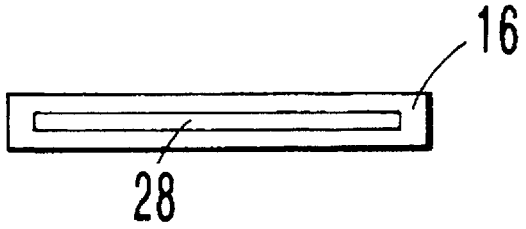
FIG. 5 shows three variants of the blast nozzle.
Figure 5B:
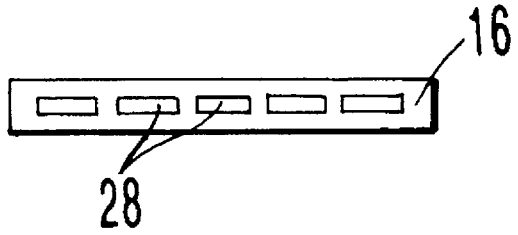
Figure 5C:
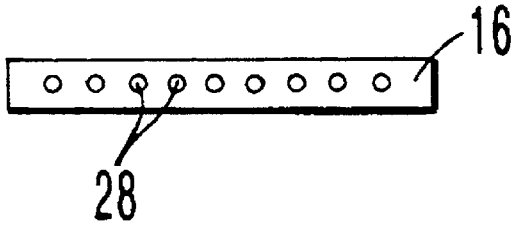

In the lower nipper plate 16 which is in the form of a hollow body there is an air chamber 26 which is connected, for instance, by an elastically expandable hose 27, continuously to a source of compressed air (not shown) also during the stroke movements. In the clamping surface of the lower nipper plate 16 which cooperates with the upper nipper plate 21, there debouches a slot nozzle 28 (FIG. 5*a*) which extends substantially over the width thereof or a series of slot openings or holes (FIG. 5*b, c*) through which the blast air can emerge from the air chamber 26 in the direction against the detachment rolls 6 below the fiber tuft 10. When the nipper head 3 is closed, the upper nipper plate 21 rests against the slot nozzle opening and closes it.

The upper nipper 14 consists, in principle, of an upper nipper arm 20 which is pivoted to the swivel pin 17 and of the upper nipper plate 21 fastened thereto, as well as of a lever firmly attached to the upper nipper arm 20. Furthermore, there is mounted on the upper nipper 14 an adjustable insertion comb 19 which retains those fibers of the fiber tuft 10 which do not have the length of the tearing distance ("ecartement") from being pulled into the detachment rolls 6. The upper nipper plate 21 is swingable in synchronism with the movement of the nipper head 3 towards and away from the lower nipper plate 16 in such a manner that the nipper head 3 is closed in the rear end position (shown in FIG. 1,) and clamps the fiber tuft 10 firmly between the lower nipper plate 16 and the upper nipper plate 21 (and closes the slot nozzle 28,) and is open in the front end position (in which the lower nipper plate 16 has arrived at a position in front of the clamping point of the detachment rolls 6 which is equal to the detachment length). The synchronization of the movement of the upper nipper 14 with the movement of the nipper head 3 is effected by means of a link 22 the ends of which are pivoted at one end on the machine stand 1 and at the other end on the lever 9 which is firmly attached to the upper nipper arm 20.

The detachment rolls 6 are formed of two pairs of detachment rolls 6', 6", each of which has a lower driven detachment roll 23 and an upper non-driven detachment roll 24. The detachment rolls 6 can also be formed by only one pair of detachment rolls 6". Their periodic forward and backward control effects (as already mentioned,) on the whole, a conveying of the top 11 in the direction indicated by the arrow 25 as well as a connection with the combed fiber tuft 10 fed by the nipper head 3.

The sector angle of the needle segment and the radius of the combing cylinder 4 are such that all needles of the needle segment 5 in the region of the rear end position (shown in FIG. 1) of the nipper head 3 comb once through the fiber tuft 10.

The drive of the comber is effected by means of a motor 31 which, via a reduction gearing 32, drives a timing shaft 33. Upon each revolution of the timing shaft 33 the machine effects one nip. A crank pin 34 which rotates with the timing shaft 33 is operatively connected by a crank rod 35 to a swivel pin 36 on a lever 36' which is firmly attached to the nipper shaft 2, the swinging movement of which during one revolution of the timing shaft 33 swings the nipper head 3 once from the rear end position into the front end position and back again.

Furthermore, the combing cylinder 4 and, via a known pilgrim-step transmission 37, the lower detachment rolls 23 are driven in synchronism by the timing shaft 33 in such a manner that their forward and return travel takes place during a nip in the same way as in the known combing machines. The circumferential speed of the brush roller 12 is greater than that of the oppositely rotating combing cylinder 4.

The manner of operation will be described below with reference to the drawing.

During a nip, the nipper head 3 swings around the nipper shaft 2 out of the rear end position (in which it comes very close to the circumference of the combing cylinder 4) into the front end position and back again, the leading edge of the lower nipper plate 16 moving over a circular arc 41. During the outward movement directed toward the detachment rolls 6, the leading edge of the lower nipper plate 16 moves away from the combing cylinder 4 and approaches it again during the return movement. During this return, the nipper head 3 closes before the needle segment 5 starts the combing-out of the fiber tuft 10 and opens again only when the needle segment 5 and the fiber tuft 10 have separated from each other. During the outward movement, the fiber tuft 10, with the nipper head open, is moved with its leading edge for piecing to the trailing end of the top 11.

Figure 2:
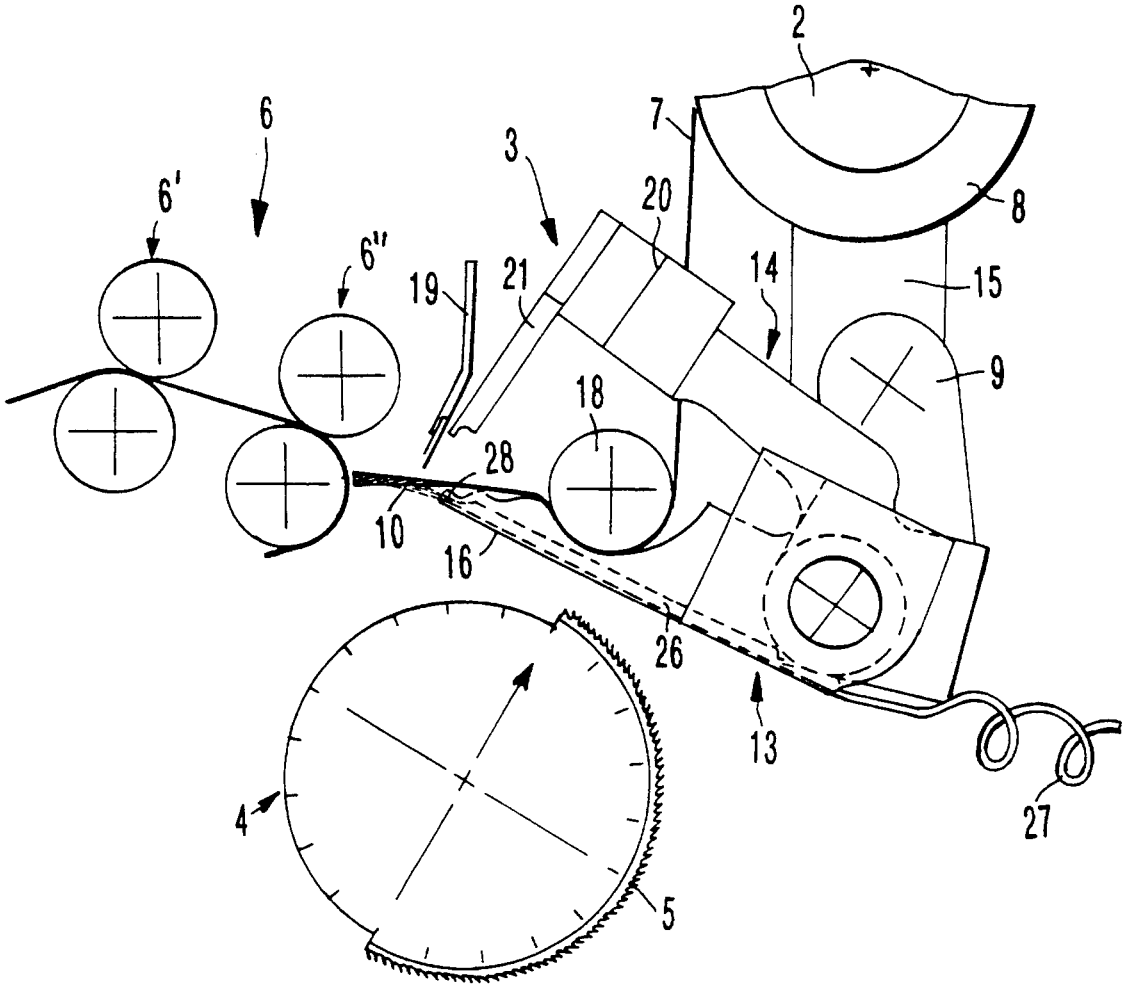
FIG. 2 is a similar, but simplified, showing of FIG. 1, shortly before the start of the piecing process.
Figure 3:
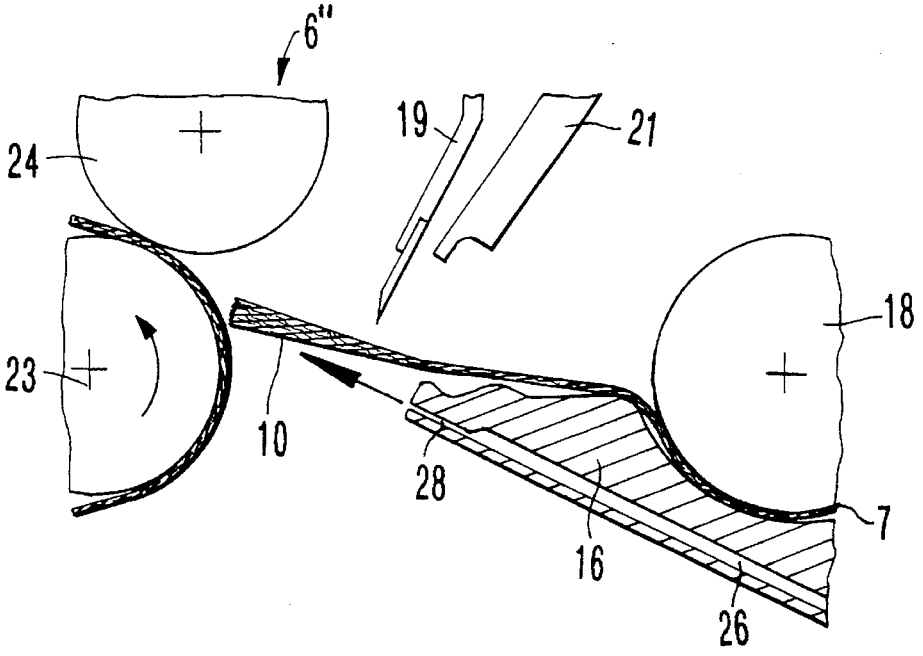
FIG. 3 shows a detail from FIG. 2 on a larger scale, partially in section.
Figure 4:
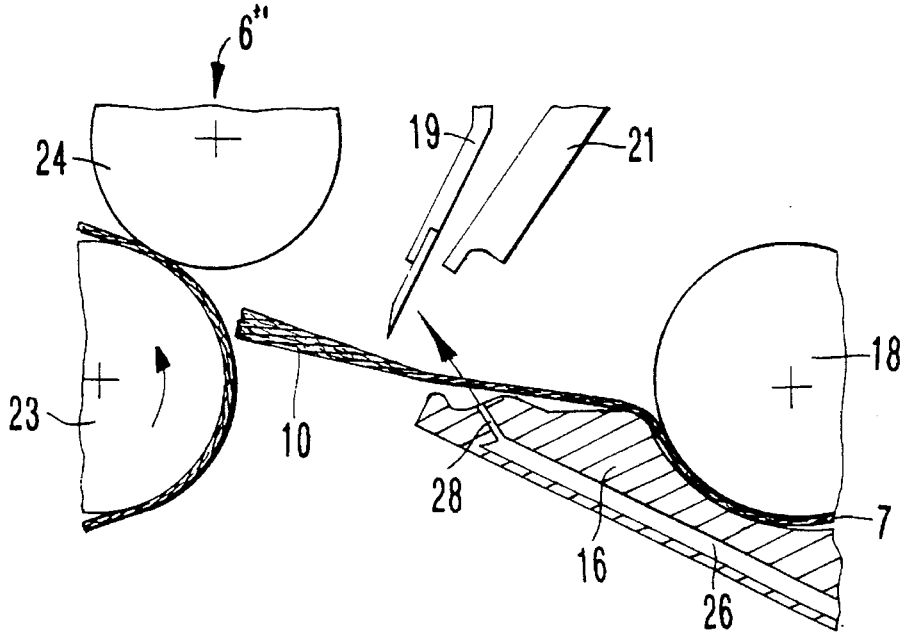
FIG. 4 is an identical showing as FIG. 3, of a second embodiment.

In order that with high nip numbers the air resistance does not press the fiber tuft 10 (in combination with its moment of inertia) downward in front of the lower nipper plate 10, the air outlet from the slot nozzle 28 (or a corresponding number of nozzle holes) is freed with the opening of the nipper 3 (FIGS. 2 to 4). The stream of air emerging from the slot nozzle 28 acts on the bottom of the fiber tuft 10 and holds it stretched in front of the lower nipper 13 which is swinging towards the detachment rolls 6. Cross-section, direction and intensity of the stream of air must be such that upon the outward movement during a nip, a well-defined position results for the fiber tuft and, accordingly, an exact impingement and placing of the tip of the fiber tuft on the trailing end of the top 25.

Between the source of compressed air (not shown) and the air chamber 26, a reduction valve can be provided by which the pressure or the speed of the air emerging from the slot nozzle 28 can be optimally adjusted as a function of the stiffness of the fiber tuft and the operating speed of the machine.

As shown in FIG. 4, the direction of the blast of air, instead of being in the direction of movement of the fiber tuft 10, can be directed at an acute angle to the lower side thereof in order to achieve a substantially flat alignment. This variant can be suitable when operating with greater amounts of blast air and lower blast-air pressure.

It is of particular importance that, at the end of the forward stroke movement, the supporting and stabilizing of the fiber tuft 10 takes place, i.e. at that moment when it comes into contact with the top 11 and the piecing commences. At the end of the forward stroke movement, the speed of which has a substantially sinusoidal course, the nipper head 3 is slowed down to standstill, as a result of which the resistance of the air decreases and the mass inertia throws the free end of the fiber tuft 10 against the top 11. During the piecing, therefore, an exactly determined position of the fiber tuft 10, and a constantly high quality of the piecing, can therefore be brought about with comparatively small blast-air velocities and quantities.

We claim:

1. A combing machine comprising:

a pair of detachment rolls and a nipper head spaced apart from the detachment rolls, the nipper head being moveable along a path toward the detachment rolls during a forward stroke of the nipper head and away from the detachment rolls during a return stroke for accomplishing a nip of a fiber tuft; and pneumatically operating forcing means adjacent a tuft clamping region of said nipper for directing an air blast towards fibers of said tuft to force said tuft in a direction towards said detachment rolls at least at an end of a forward stroke of said nipper head.

2. A combing machine comprising:

a pair of detachment rolls and a nipper head spaced apart from the detachment rolls, the nipper head being movable along a path toward the detachment rolls during a forward stroke of the nipper head and away form the detachment rolls during a return stroke for accomplishing a nip of a fiber tuft;

forcing means operative pneumatically for providing a blast of air, said forcing means being positioned on said path and being oriented toward a tuft clamping region of said nipper for arranging fibers of the tuft; and wherein said forcing means comprises a blast nozzle.

3. A combing machine according to claim 2, wherein the nipper head comprises an upper nipper with a knife, and a lower nipper with a lower nipper plate;

wherein the knife and the lower nipper plate have clamping surfaces;

the knife and the lower nipper plate, upon a closure of the nipper head, contact each other via their respective clamping surfaces; and said blast nozzle acts at least approximately in a direction of the forward stroke, and debouches in the clamping surface of the lower nipper plate.

4. A combing machine according to claim 3, wherein said blast nozzle extends over the width of one of said clamping surfaces, and comprises one or more nozzles arranged alongside of each other, said nozzles being slotted or round hole nozzles.

5. A combing machine according to claim 4, further comprising:

a air chamber in said lower nipper plate, and a source of compressed air;

wherein said blast nozzle is connected via said air chamber to said source of compressed air.

6. A combing machine according to claim 3, wherein said blast nozzle is a blast air nozzle, and the blast air nozzle is blocked only upon said closure of said nipper head.

* * * * *